US006206193B1

(12) United States Patent
Wu

(10) Patent No.: US 6,206,193 B1
(45) Date of Patent: Mar. 27, 2001

(54) PACKING BOX

(76) Inventor: Yin-Yin Wu, No.2, Lane 9, Chin Fu Street, Chutung Town, Hsinchu Hsien (TW)

( * ) Notice: Subject to any disclaimer, the term of this patent is extended or adjusted under 35 U.S.C. 154(b) by 0 days.

(21) Appl. No.: 09/499,453

(22) Filed: Feb. 7, 2000

(51) Int. Cl.[7] ..... B65D 85/00
(52) U.S. Cl. ..... 206/575; 206/457
(58) Field of Search ..... 206/45.2, 45.23, 206/457, 573, 575, 579; 446/73, 75

(56) References Cited

U.S. PATENT DOCUMENTS

| | | | | |
|---|---|---|---|---|
| 4,988,321 | * | 1/1991 | Goldfarb | 446/75 |
| 5,013,278 | * | 5/1991 | Dixon | 446/73 |
| 5,100,324 | * | 3/1992 | Slayton | 206/579 |
| 5,163,863 | * | 11/1992 | Goldfarb et al. | 446/75 |
| 6,026,960 | * | 2/2000 | Cogliano | 206/575 |

* cited by examiner

*Primary Examiner*—David T. Fidei
(74) *Attorney, Agent, or Firm*—Rosenberg, Klein & Lee

(57) ABSTRACT

The present invention relates to a packing box transformable to real scenery display table mainly having two connectable cases inside of which an accommodation space is disposed in order to receive and fix all kinds of objects; accordingly, a basic structure of the packing box is created and characterized in that the surfaces of the two cases of the packing box are respectively provided with real scenery plain patterns corresponding to accommodated objects; locating surfaces for receiving the objects are disposed at pre-arranged position; moreover, when the two cases with downward opening are connected on a basic surface, the packing box is developed to a real scenery display table so that the objects accommodated inside can be located on the pre-arranged locating surfaces to create a three-dimensional effect. Moreover, the cases have preset battery chambers and connectable leads, and a plurality of plug sockets are mounted on the leads so that the power required by the light of the objects can be directly supplied.

1 Claim, 5 Drawing Sheets

PACKING BOX

BACKGROUND OF THE INVENTION

1. Field of the Invention

The present invention relates to an improvement of a packing box, and more particularly, to a packing box transformable to a real scenery display table.

2. Description of the Prior Art

Most of the conventional packing boxes have only the storing function so that the packing boxes are discarded when the objects inside are taken out. Therefore, it causes an unnecessary waste. In addition, many objects after taking out from the packing box require another display table to be placed upon for product demonstration and watching enjoyment. Accordingly, these kinds of products need an additional display table; however, the display table has a large volume, and this is unfavorable for packaging and transport. Moreover, the cost will be increased.

In addition, a light is installed for illuminating the decoration objects so that a power supply is required. Conventionally, the display table is fitted with a visible external power cable connected to mains socket causing the power cable disposed around the object. Not only is it inconvenient for the installation, but also the beautiful appearance of the whole body is destroyed.

SUMMARY OF THE INVENTION

It is a primary object of the present invention to provide a packing box which is transformable to a real scenery display table in order to reduce the transport volume and to facilitate the carrying.

It is another object of the present invention to provide a packing box which is transformable to a real scenery display table in order to reach a recycling goal and to reduce the cost.

It is a further object of the present invention to provide a packing box which is transformable to a real scenery display table on which a power supply device is mounted for the decoration objects.

BRIEF DESCRIPTION OF THE DRAWINGS

The drawings disclose an illustrative embodiment of the present invention which serve to exemplify the various advantages and objects hereof, and are as follows.

DETAILED DESCRIPTION OF THE PREFERRED EMBODIMENT

Figure 1:
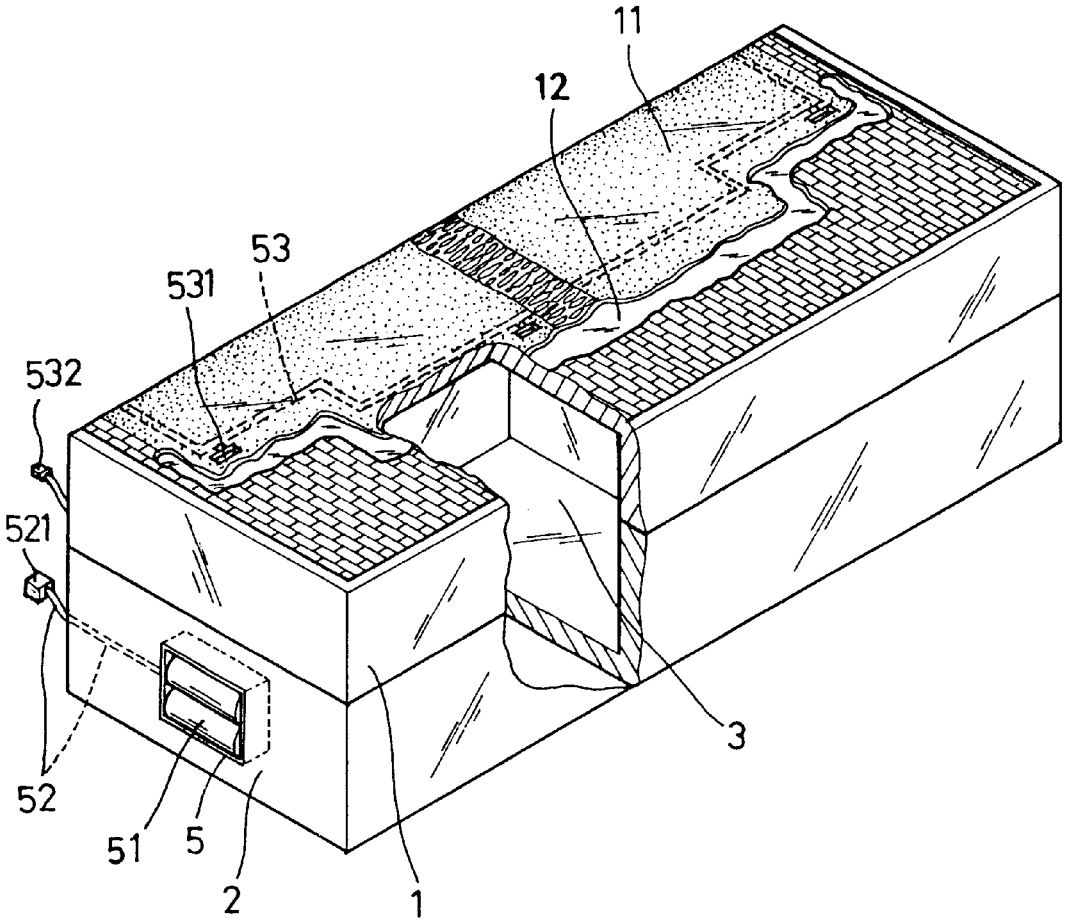
FIG. 1 is a perspective view of the front side of the present invention.
Figure 2:
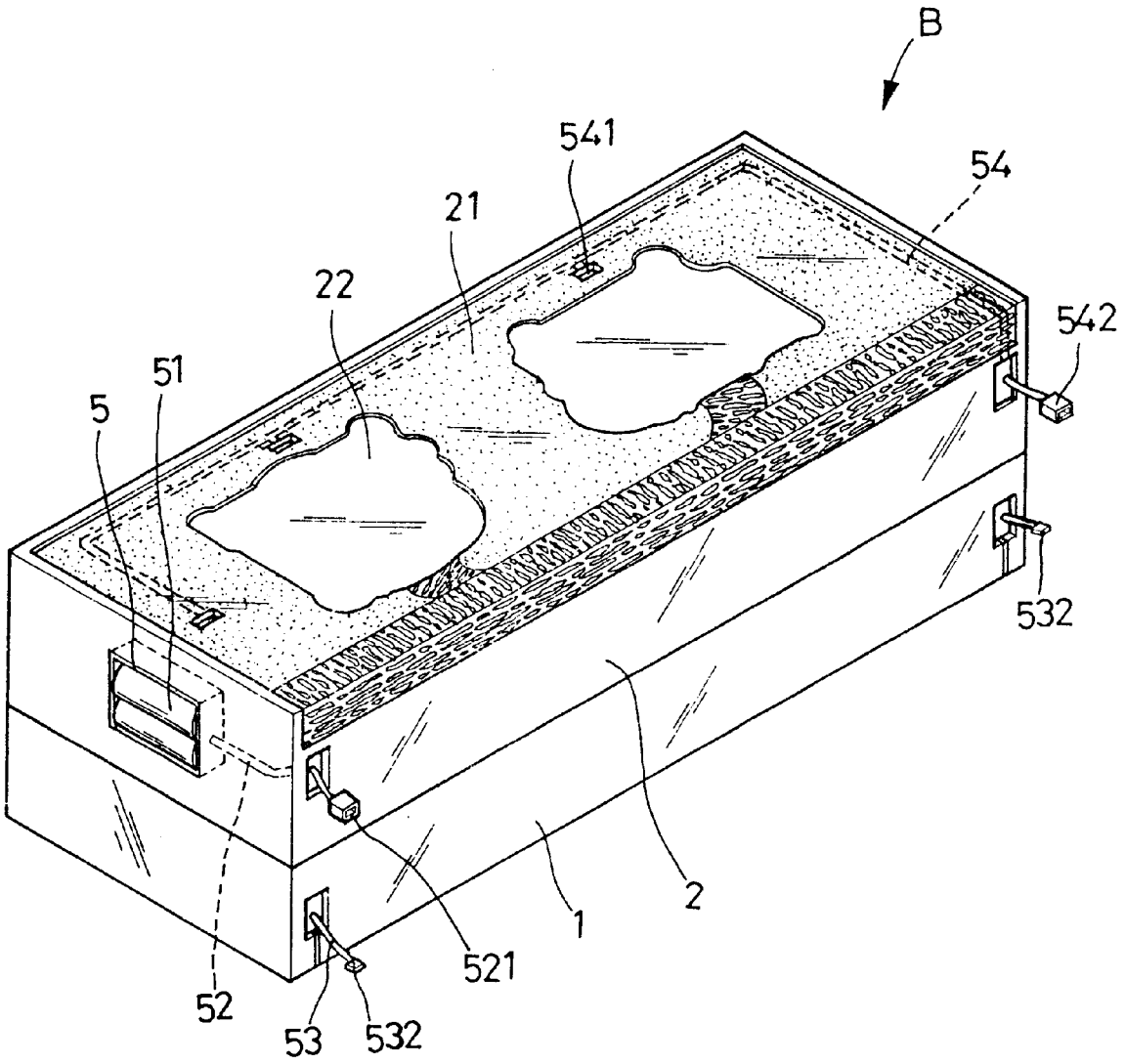
FIG. 2 is a perspective view of the rear side of the present invention.
Figure 3:
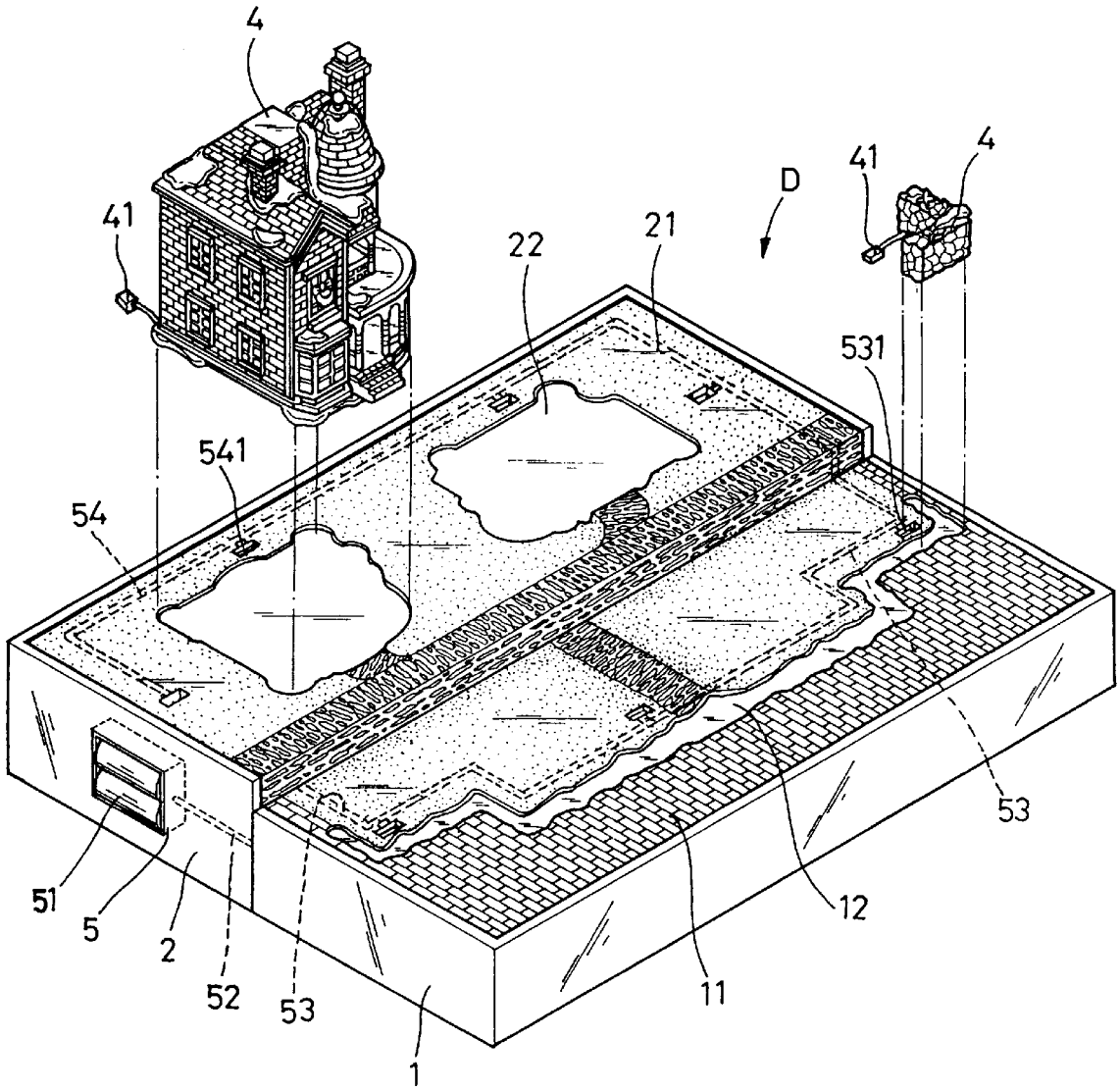
FIG. 3 is a perspective view of the structure of the present invention.
Figure 4:
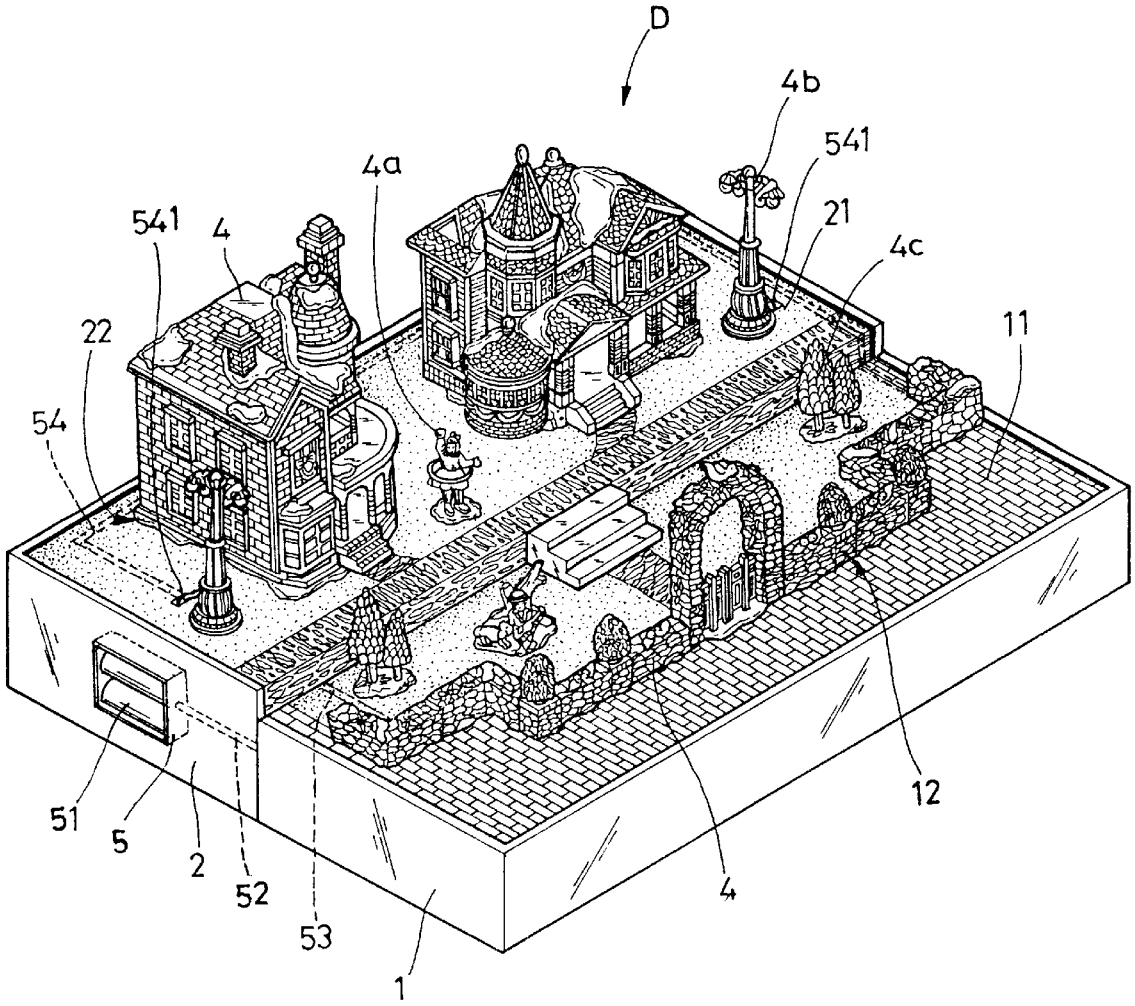
FIG. 4 is an application example of the present invention.

First of all, referring to FIGS. 1 through 4, the packing box transformable to real scenery display table in accordance with the present invention includes two connectable cases 1, 2 inside of which an accommodation space 3 is disposed in order to receive and fix all kinds of objects; accordingly, a basic structure of the packing box (B) is created and characterized in that the surfaces of the two cases 1, 2 of the packing box (B) are respectively provided with real scenery plain patterns 11, 21 corresponding to accommodated objects 4; locating surfaces 12, 22 for receiving the objects 4 are disposed at pre-arranged positions; moreover, when the two cases 1, 2 with downward opening are connected on a basic surface, the packing box (B) is developed to a real scenery display table (D) so that the objects 4 accommodated inside can be located on the pre-arranged locating surfaces 12, 22 to create a three-dimensional effect.

Furthermore, the real scenery plain patterns 11, 21 can be adhered to the surfaces of the two cases 1, 2 in a sticking manner.

Again, the locating surfaces 12, 22 are created in accordance with the form of the objects 4, and they can be grooved in order to stably fix the objects 4.

Certainly, a plurality of attached objects (4*a*, 4*b*, 4*c*) can be freely placed without fastening and reach the goal of various changes.

Figure 5:
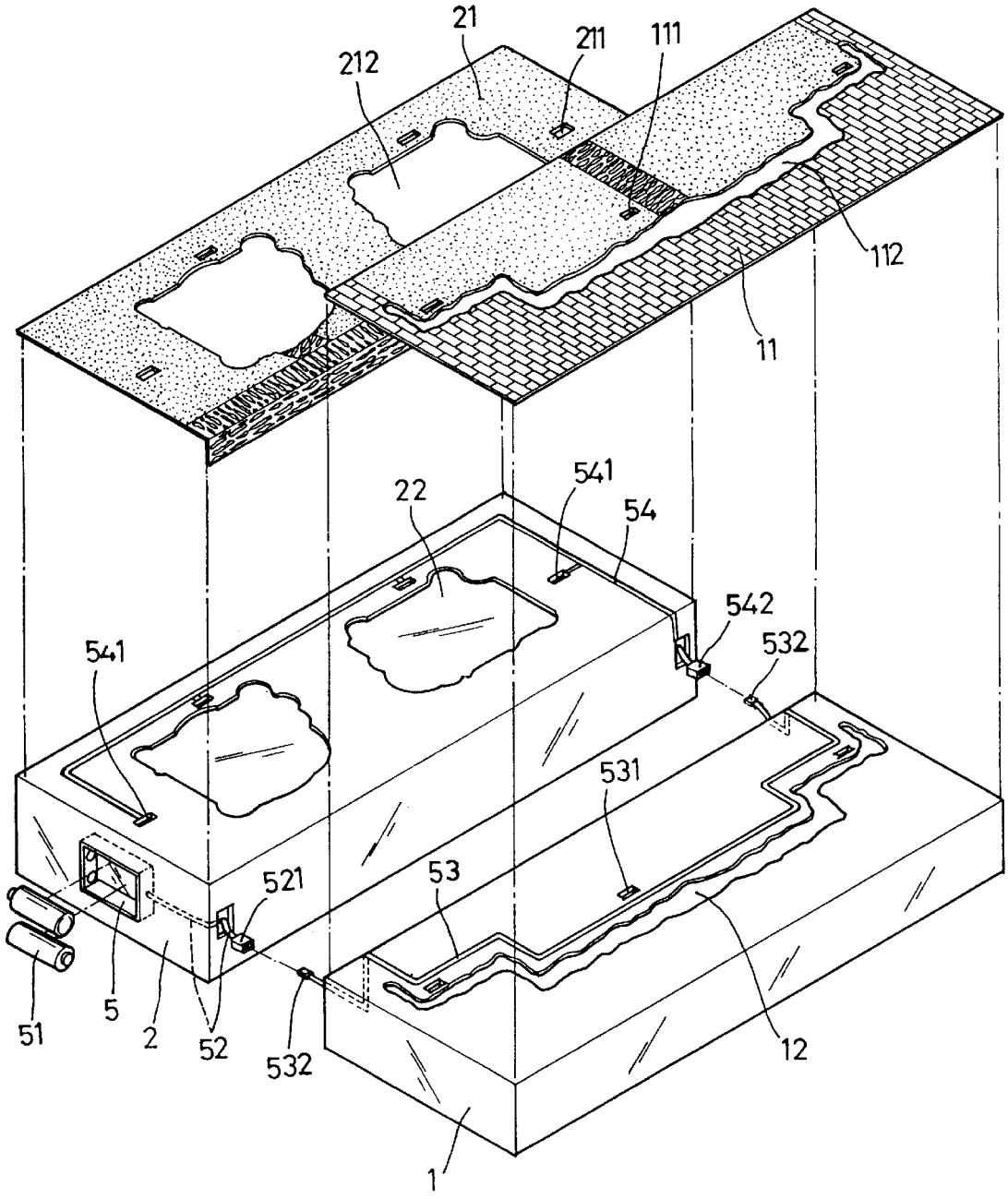
FIG. 5 is a perspective exploded view of an applicable embodiment of the present invention.

Moreover, referring to FIG. 5, it illustrates that the real scenery display table (D) in accordance with the present invention has the capacity to directly supply the electric power. The case 2 is provided with a battery chamber 5 at the side thereof for accommodating batteries 51. A first lead 52 is connected to the battery chamber 5, and a connection terminal is fitted to the end of the first lead 52. A third lead 54 is mounted on the surface of the case 2, and at least one plug socket 541 is disposed at a prearranged position of the third lead 54. Similarly, a second lead 53 is mounted on the surface of the case 1, and at least one plug socket 531 is disposed at a prearranged position of the second lead 53. The second lead 53 is provided with a connection terminal 532 at two ends thereof respectively, and these two connection terminals 532 can be connected to the connection terminal 521 of the first lead 52 and the connection terminal 542 of the third lead 54 respectively so that the three leads create a continuous power supply.

The real scenery plain patterns 11, 21 have slotted holes 111, 112, 211, 212 respectively corresponding to the plug sockets 531, 541 and the locating surfaces 12, 22 so that each lead can be covered and only the plug sockets 531, 541 is exposed for insertion when the real scenery plain patterns 11, 21 are adhered to the surfaces of the cases 1, 2.

It's preferable that the second and the third leads 53, 54 are formed in thin current wire and flat stuck to the surface of the two case 1, 2 so that the surfaces can be in a smooth and flat state after the real scenery plain patterns 11, 21 are adhered. Additionally, it will also be preferable that each plug socket 531, 541 is pre-placed within the two case 1, 2 and only the plug slots are exposed.

Returning to FIG. 3 and 4, the objects 4 have been installed with lights (not shown) and plugs 41; consequently, the plugs 41 can be directly inserted into the respective plug sockets 531, 541 of the cases 1, 2 after the objects are placed upon the respective locating surfaces so that each object 4 is luminous without being externally connected with an extension cable. Accordingly, it is very convenient and beautiful.

By means of the above-mentioned structure, the packing box (B) in accordance with the present invention is advantageous for transporting and carrying in addition to accommodating and fixing the objects 4. After reaching the delivery place, the packing box can be immediately used as a real scenery display table (D). Thus, not only can the material volume be greatly saved, but also one object with two functions so that its economic efficiency and convenience can be fully achieved.

Many changes and modifications in the above-described embodiment of the invention can, of course, be carried out without departing from the scope thereof Accordingly, to promote the progress in science and the useful arts, the invention is disclosed and is intended to be limited only by the scope of the appended claim.

What is claimed is:

1. A packing box transformable to real scenery display table primarily comprising two connectable cases, a n accommodation space being disposed within said cases in order to receive and fix all kinds of objects, wherein said packing box is characterized by:

the surfaces of said two cases of said packing box being respectively provided with real scenery plain patterns corresponding to accommodated objects, locating surfaces for receiving said objects being disposed at pre-arranged positions, said packing box being developed to a real scenery display table when said two cases with downward opening are connected on a basic surface so that said objects accommodated inside can be located on said pre-arranged locating surfaces to create a three-dimensional effect, said case being provided with a battery chamber at the side thereof for accommodating batteries, a first lead being connected to said battery chamber, and a connection terminal being fitted to the end of said first lead, a third lead being mounted on the surface of said case, and at least one plug socket being disposed at a prearranged position of said third lead, a second lead being mounted on the surface of said case, and at least one plug socket being disposed at a prearranged position of said second lead, and said second lead being provided with a connection terminal at two ends thereof respectively, and said two connection terminals being connected to said connection terminal of said first lead and said connection terminal of said third lead respectively so that the three leads create a continuous power supply.

* * * * *